US010436462B1

(12) United States Patent
Baumgartner et al.

(10) Patent No.: US 10,436,462 B1
(45) Date of Patent: Oct. 8, 2019

(54) VENT BYPASS SYSTEM

(71) Applicants: Paul Baumgartner, Port St. Lucie, FL (US); Jonathan J. Ricciardi, West Richland, WA (US)

(72) Inventors: Paul Baumgartner, Port St. Lucie, FL (US); Jonathan J. Ricciardi, West Richland, WA (US)

( * ) Notice: Subject to any disclaimer, the term of this patent is extended or adjusted under 35 U.S.C. 154(b) by 319 days.

(21) Appl. No.: 14/886,124

(22) Filed: Oct. 19, 2015

(51) Int. Cl.
*F24F 3/16* (2006.01)

(52) U.S. Cl.
CPC ..... *F24F 3/16* (2013.01); *F24F 2003/1664* (2013.01)

(58) Field of Classification Search
CPC ..... F24F 3/16; F24F 2003/1664; F24F 13/15; F16M 11/24; F16M 11/28; F16M 11/26; F16M 11/242; F16K 31/56; F16K 31/14; F16K 31/46; F16K 35/14; E06B 7/18; E06B 7/02
USPC ..... 454/187; 49/463, 466
See application file for complete search history.

(56) References Cited

U.S. PATENT DOCUMENTS 4,902,315 A * 2/1990 Spicer ..... B01D 46/42 454/238
5,165,732 A * 11/1992 Townsend ..... F16L 13/163 126/307 R
5,702,296 A * 12/1997 Grano ..... F24F 7/013 165/54
5,724,701 A * 3/1998 Jones ..... B01D 46/0032 15/304
8,359,984 B1 * 1/2013 Wolf, II ..... A61L 9/14 108/147.19
8,506,900 B1 * 8/2013 Ricciardi ..... A61L 2/04 422/292
9,211,354 B2 * 12/2015 Hill ..... A61L 2/22
2004/0184950 A1 * 9/2004 McVey ..... A61L 2/208 422/4
2010/0233020 A1 * 9/2010 Klaassen ..... A61L 2/208 422/20
2011/0123394 A1 * 5/2011 Plantinga ..... A61L 2/18 422/28

* cited by examiner

*Primary Examiner* — Vivek K Shirsat
*Assistant Examiner* — Ryan L Faulkner
(74) *Attorney, Agent, or Firm* — Donald J. Ersler

(57) ABSTRACT

A vent bypass system is created by forming a bypass hole through a vent cover door of two adjacent vent cover doors. A tube flange is extended from a bottom surface of the vent cover door, concentric with the bypass hole. A first vent cover door covers an entry vent and the second vent cover door covers an exit vent. One end of a flexible tube is secured to one of the two tube flanges and the other end of the flexible tube is secured to the other one of the two tube flanges. Air/gas blown into the room will bypass circulating through the room by going through the flexible tube from the entry vent to the exit vent. Any suitable means to connect the various vents can be used, such as, but not limited to any pipe, hose, tube, conduit, or the like.

12 Claims, 14 Drawing Sheets

VENT BYPASS SYSTEM

BACKGROUND OF THE INVENTION

1. Field of the Invention

The present invention relates generally to disinfecting a hospital room and more specifically to a vent bypass system, which covers and connects inbound air/gas vents to other covered outbound air/gas vents, which can reduce, and eliminate, the movement of any air, gas, or aerosol, from moving into or out of any sealed or closed room(s) or space(s).

2. Discussion of the Prior Art

A vent cover is placed over a heating/cooling vent, which is a portion of a HVAC System, when a hospital room is disinfected. Automation of the vent covering process speeds up the disinfection process. U.S. Pat. No. 8,359,984 ('984 patent) to Wolf II et al. discloses a portable automated vent cover. U.S. Pat. No. 8,359,984 is herein incorporated into this patent application by reference in its entirety. However, the vent cover door of the '984 patent does not always release from a vent opening without manual intervention on the part of an operator, because the vacuum in the vent retains the vent cover door against the vent opening.

Accordingly, there is a clearly felt need in the art for a vent bypass system that covers and connects inbound air/gas vents to other covered outbound air/gas vents, which can reduce, and eliminate, the movement of any air, gas, or aerosol, from moving into or out of any sealed or closed room(s) or space(s).

SUMARY OF THE INVENTION

The present invention provides a vent cover system, which allows a vent cover door to be withdrawn from a vent opening without operator intervention. The vent cover system preferably includes a portable automated vent cover and the vacuum release door. The portable automated vent cover includes a drive system, a telescoping tube, a vent cover door and a collapsible mobile tripod. The telescoping tube includes an outer support tube and an inner cover tube that slides within the outer support tube. A bottom of the outer support tube is attached to the collapsible mobile tripod. The drive system is retained at a top of the outer support tube. The drive system moves the inner cover tube along a vertical axis. However, the drive system may be replaced with a manual lift system to provide a portable manually operated vent cover.

The vacuum release door preferably includes a vacuum door plate, a plurality of retention pins, a sealing gasket and a tube flange. The sealing gasket includes the same outer perimeter as the vacuum door plate. A vacuum break opening is formed through a center of the vent cover door. The vacuum break opening can be any suitable size and the vacuum release door may drop any suitable distance. The sealing gasket is preferably attached to a top of the vacuum door plate. A plurality of pin holes are formed around a perimeter of the vacuum door plate to slidably receive the plurality of retention pins. Each retention pin includes a head portion and a pin portion. The pin portion extends from the head portion. The pin portion is inserted through the plurality of pin holes and attached to the vent cover door with fasteners or the like. The tube flange includes a tube opening, which is sized to snugly receive a top end of the inner cover tube. The tube flange is attached to a bottom of the vacuum door plate.

In use, the vent cover door is raised, until a peripheral sealing ring on a top of the vent cover door seals around a perimeter of a vent opening. When an attempt is made to lower the vent cover door from the vent opening, the inner cover tube will first cause a seal to be broken between the vacuum door plate and the vent cover door. After the seal is broken, the plurality of retention pins will experience a downward force, which will cause a seal between the vent cover door and the vent opening to be broken. The vent cover system makes it easier to break a seal between the vent opening and the vent cover door, because the perimeter of the vacuum release door is much smaller than a perimeter of the vent cover door. Consequently, it is easier to break a small length seal than a larger length seal.

A vent bypass system is created by forming a bypass hole through a vent cover door of two adjacent vent cover doors. A tube flange is extended from a bottom surface of the vent cover door, concentric with the bypass hole. A first vent cover door covers an entry vent and the second vent cover door covers an exit vent. One end of a flexible tube is secured to one of the two tube flanges and the other end of the flexible tube is secured to the other one of the two tube flanges. Gas (air, gas, aerosol, vapor or gaseous substance) blown into the room will bypass circulating through the room by going through the flexible tube from the entry vent to the exit vent. Any suitable means to connect the various vents can be used, such as, but not limited to any pipe, hose, tube, conduit, or the like. The vent bypass system will also keep a balance in a circulating system by not sealing up a normal flow pattern through the room.

It is preferred, without limitation, that this connection or communication between these vents and their covers or sealed covers, is complete, without any leaking, or at least without any substantially effective leaking, of substances such as, but not limited to any, gas(s), vapor(s), and/or aerosol(s).

This can be, without limitation, accomplished by combining and effectively connecting or interfacing one or more of any means such as, but not limited to, any effective, channeling, piping, hose, and/or ducting, (Herein called "Hose"), with or to, one or more of any effective means to cover and/or seal one or more of any "entry vent(s)" and "exit vent(s)" (Herein called "Vent cover(s)"). Without being limited, the one or more "vent cover(s)" can be, without limitation, one or more of any effective means to cover, close, seal, and/or seal, around and/or to, one or more of any "entry vent(s)" and "exit vent(s)". It is preferred, without limitation, that the "vent cover(s)" is any vent cover plate, and more preferably any vent cover door.

It is preferred, without limitation, that the one or more hose(s) are effectively interfaced and connected to the the various vent cover(s), all in a manner known to those skilled in the art. It is even more preferred, without limitation, that these one or more hose(s) have an easily releasable and effectively air-tight connection(s) to the the vent cover(s), all in a manner known to those skilled in the art. Without being limited, the hose(s) may connect directly or indirectly to any vent cover(s) in one or more of any location(s) or position(s). It is preferred, without limitation, that the location(s) or position(s) are at least effective. Also, and without being limited, the hose(s) may connect directly or indirectly to the vent cover(s), in one or more of any ways such as, but not limited to using any, connected component(s), structure(s), pipe(s), connection(s), connector(s), male and female connector(s), conduit(s), hose(s), and the like (Herein called "Hose Connection(s)").

Any hose(s) known to those skilled in the art, may be used in the present invention. Without being limited, each hose(s) that is utilized, can have any effective and suitable, length, diameter, width, flexibility, material, shape, construction, and design. Without being limited, one or more of any suitable and effective hoses may be used in the same room(s) or area(s).

The diameter of the various hoses can vary for various reasons including, but not limited to, the flow rate or volume of air and/or gas(s), leaving and/or entering the various vents. It is preferred, without limitation, that the hose(s) have a diameter between less than one-quarter (0.25) inch to about eight (8) inches or more. It is more preferred, without limitation, that the hose(s) have a diameter between about one (1) inch to about six (6) inches. It is even more preferred, without limitation, that the the hose(s) have a diameter between about one (1) inch to about three (3) inches. It is very preferred, without limitation, that the the hose(s) have a diameter of about two (2) inches.

Without being limited, the hose(s) may be constructed in various ways such as, but not limited to, being smooth or ribbed. The hose(s) may also be made from one or more of any material(s). It is preferred, without limitation, that the hose(s) are constructed from any flexible ribbed polypropylene that is suitable.

The one or more of any "entry vent(s)" and "exit vent(s)", can be located in one or more of any location(s), space(s), and/or room(s). It is preferred, without limitation, that the "entry vent(s)" and "exit vent(s)", are located in the same, or at least effectively connected, location(s), space(s), and/or room(s).

Without being limited, this new apparatus and method, can be used to, without limitation, balance, equalize, eliminate, and/or effectively reduce, any positive and/or negative air or atmospheric pressure within any room(s), space(s), and/or sealed room(s). However, it is preferred, without limitation, that this new apparatus and method, is used to effectively reduce or even effectively eliminate, the movement of one or more substance such as, but not limited to any, air, gas(s), vapor(s), and/or aerosol(s) from entering and/or leaving the one or more, room(s), space(s), and/or targeted area(s), in which the "entry vent(s)" and "exit vent(s)" are located. It is also more preferred, without limitation, that this new apparatus and method is used to effectively seal any "entry" and "exit" vent(s) or port(s) in a sealed area or room, and carry at least some, but preferably all, of the air, gas(s), or other substances, via suitable hose(s), from the one or more of any vent(s) meant to supply any, air, gas(s), or other substances, into one or more of any, room(s), space(s), and/or sealed room(s), to one or more of any other vent(s) that are meant to remove or exhaust any, air, gas(s), or other substances, out of the same one or more room(s) or space(s), or at least any effectively connected, room(s), space(s), and/or sealed room(s) or space(s).

Any vent cover design(s) known in the art, and any one or more of any hose(s) connected to any of the one or more vent cover(s), can be interfaced or connected to one or more of any effective means to effectively, position, cover, and/or seal, the "entry vent(s)" and "exit vent(s)".

Broadly, and without limitation, one or more of any means, such as, but not limited to any, poles, masts, telescoping tubes, support structure(s), and/or support structure(s), that can be adjusted and/or moved for any length, height, and/or distance, may be directly and/or indirectly connected to one or more of any vent cover(s), and used to apply, transfer, or help to transfer, one or more of any effective pressure(s) and/or force(s), to the vent cover(s), and/or any connecting sealing material(s), to help them cover, and/or seal on and/or around, one or more of any entry vent(s) and/or exit vent(s). The one or more vent cover(s) may be moved into or out of any location or position, in any effective manner, such as but not limited to, mechanically, manually, automatically, automated, and/or non-automated. It is preferred, without limitation, that the various vent cover(s) are positioned or moved into any effective location, with an automated vent cover apparatus described in U.S. Pat. No. 8,359,984 (Wolf II et al.).

In a preferred detailed summary aspect, and without limitation, one or more of any vent cover(s) can be also be attached to any manually extendable means known to those in the art such as, but not limited to any, manually extended pole(s) that can be effectively arrested or locked at any length or height (Herein called "Pole"), and can hold one or more vent cover(s) on its end. The pole can be, without limitation, manually extended and arrested or locked at any effective length, and used to manually position the vent cover(s), and their accompanying one or more connected hose(s) over, around, and/or against, the "entry vent(s)" and/or "exit vent(s)". It is preferred, without limitation, that a suitable vent cover with one or more connecting hose(s), is suitably connected to this type of manually adjusted pole, and an end of this pole, preferably one or more of any effective member or end of any member on the opposing side, without the vent cover, is interfaced with a surface such as, but not limited to any, floor, and the pole is manually extended in length until the connected vent cover is effectively positioned and covering and/or sealing the vent cover(s).

In another more preferred summary aspect, and without limitation, one or more of any vent cover(s) can also be suitably attached to any automated and extendable means such as, but not limited to, the one that has already been disclosed in U.S. Pat. No. 8,359,984 (Wolf II et al.). The automated lifting and lowering means described in the U.S. Pat. No. 8,359,984 (Wolf II et al.), can also be used, without limitation, to effectively locate one or more vent cover(s), and their accompanying one or more connected hoses, over, around, and/or against, the "entry vent(s)" and/or "exit vent(s)". It is preferred, without limitation, that a suitable vent cover with one or more connecting hose(s), is suitably connected to an apparatus as described in U.S. Pat. No. 8,359,984 (Wolf II et al.), and the vent cover is positioned using this automated device so that one or more targeted vent opening(s) is effectively covered and/or sealed by the vent cover(s).

Without being limited, the various hose(s) can be added or removed from the various vent cover(s) at any suitable time. It is preferred, without limitation, that the various hose(s) are added to the various vent cover(s), before the various vent cover(s) are raised into position to cover and/or seal the "entry vent(s)". It is also preferred, without limitation, that the various hoses are removed from the various vent cover(s), after the vent cover(s) are lowered and uncovered and/or unsealed from the "entry vent(s)" and the "exit vent(s)".

Certain spaces or areas such as, but not limited to any, hospital room(s), operating room(s), clean room(s), clean area(s), laboratory area(s), and/or production area(s), can have one or more "entry" vent(s) and "exit" vent(s) that may require being covered and/or sealed with the improvements disclosed in the present invention. Without being limited, this can influence the number of hoses and associated components that are used. One or more of any suitable and effective combination(s) of the one or more vent cover(s), hose(s), and their various connection(s), may be made.

In one example, and without limitation, a hospital room can have one [1] "entry" vent, and two [2] "exit" vent(s). In this example, a vent cover is positioned and effectively sealed into place over the "entry" vent, via any suitable automatic, mechanical, or manual means, known in the art. Two [2] hose(s) are suitably interfaced and connected with this "entry" vent cover, with any suitable hose connection device known to those skilled in the art. A vent cover is also positioned and effectively sealed into place over each of the other two [2] "exit" vents, via any suitable automatic, mechanical, or manual means, known in the art. One of the hoses that extends from the "entry" vent cover is suitably interfaced and connected with one of the "exit" vent covers, with any suitable hose connection device known to those skilled in the art. One of the other hoses that extends from the "entry" vent cover is also suitably interfaced and connected with one of the other "exit" vent covers, with any suitable hose connection device known to those skilled in the art.

In another example, and without limitation, a hospital room can have two [2] "entry" vents, and one [1] "exit" vent(s). In this example, a vent cover is positioned and effectively sealed into place over each of the "entry" vents, via any suitable automatic, mechanical, or manual means, known in the art. One [1] hose is suitably interfaced and connected with each of these "entry" vent covers, with any suitable hose connection device known to those skilled in the art. A vent cover is also positioned and effectively sealed into place over the one [1] "exit" vent, via any suitable automatic, mechanical, or manual means, known in the art. Each of the hoses that extends from each of the "entry" vent covers is suitably interfaced and connected with the one "exit" vent cover, with any suitable hose connection device known to those skilled in the art.

According to an embodiment, and without limitation, the vent cover can also have any effective, shape, geometry, volume, height, length, width, and depth. The vent cover can also be modified to effectively cover and seal around objects such as, but not limited to any, smoke detectors, fire alarms, lights, and the like.

Accordingly, it is object of the present invention to provide a vent bypass system, which is positioned, either manually, or via any effective automated means, over one or more of any inbound and/or outbound air/gas vents, and rerouting the airflow from one or more of any "entry" vent(s) to one or more of any "exit" vent(s), through one or more of any effective hose connection(s), thus preventing unwanted airflow into or out of any room(s) or targeted space(s). Any one or more combination(s), of one or more of any components such as, but not limited to any, air/gas entry vent(s), air/gas exit vent(s), vent cover(s), hose(s), and hose coupling device(s), may be connected in any number of ways, all in a manner known to those skilled in the art.

These and additional objects, advantages, features and benefits of the present invention will become apparent from the following specification.

DETAILED DESCRIPTION OF THE PREFERRED EMBODIMENTS

Figure 6:
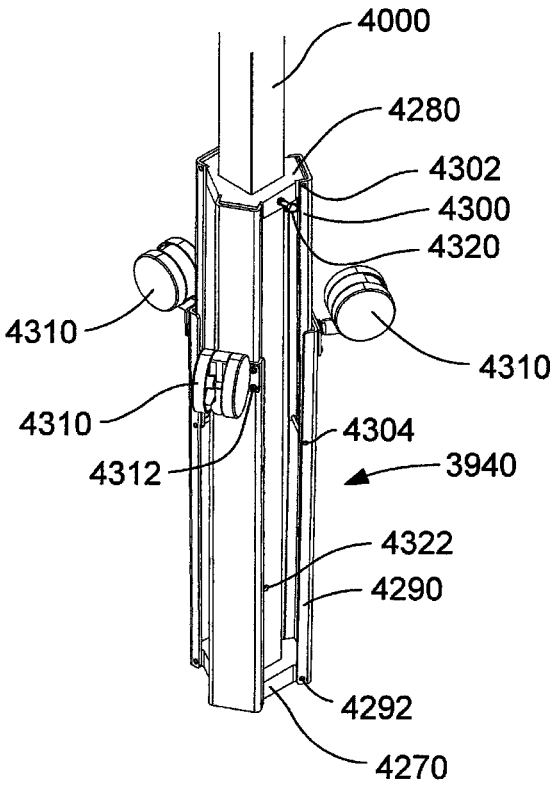
FIG. 6 is an enlarged perspective view of a mobile tripod of a portable automated vent cover in a collapsed orientation.
Figure 7:
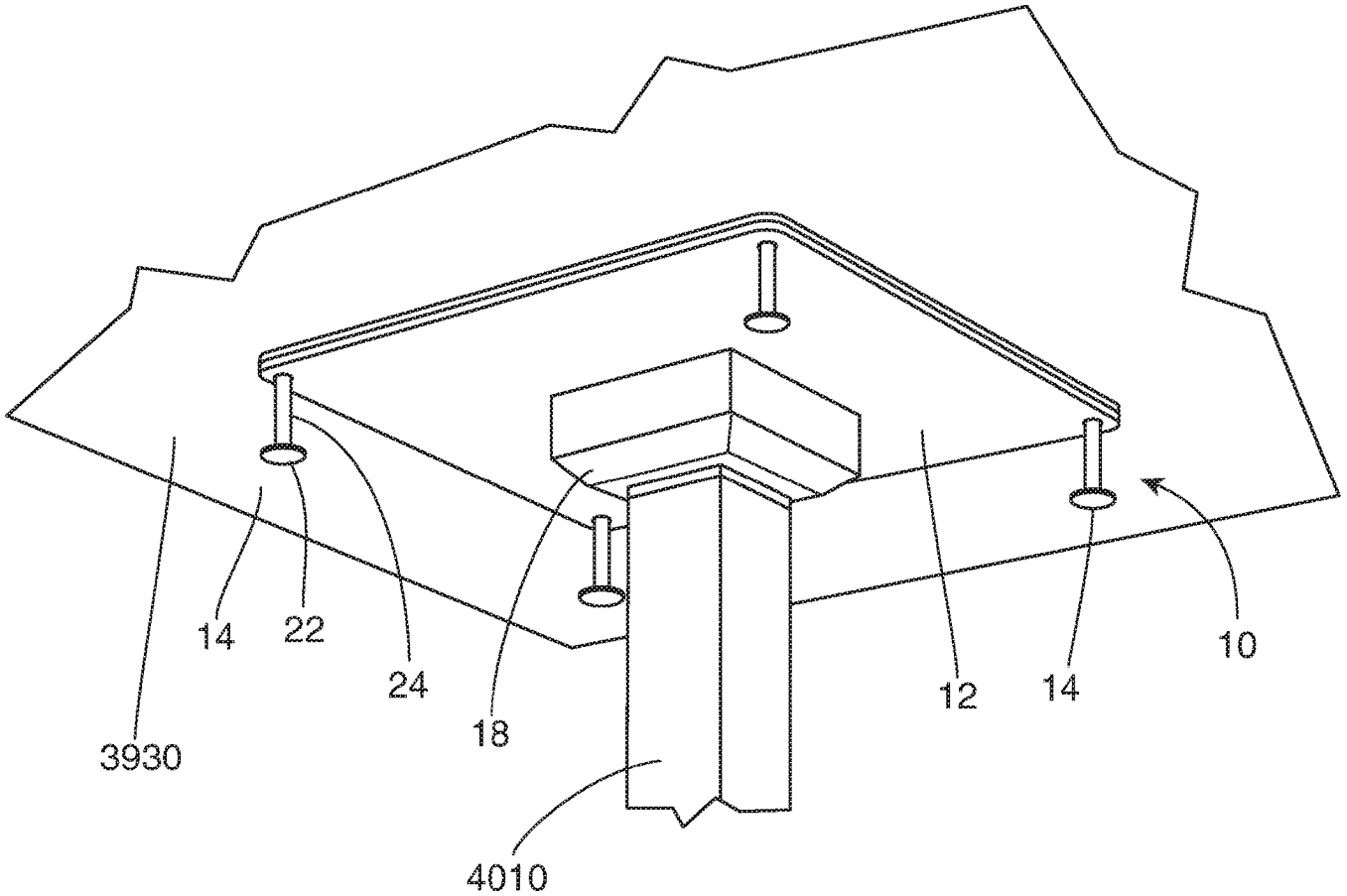
FIG. 7 is a bottom perspective view of a vacuum release door in contact with a vent cover door of a vent cover system in accordance with the present invention.

With reference now to the drawings, and particularly to FIG. 7, there is shown a perspective view of a vacuum release door (10) in contact with a bottom of a vent cover door (3930) of a portable automated vent cover 3900. With reference to FIG. (10), a vent cover system (1) preferably includes the portable automated vent cover (3900) and the vacuum release door (10). With reference to FIGS. 1-6, the portable automated vent cover (3900) preferably includes a drive system (3910), a telescoping tube (3920), a vent cover door (3930) and a collapsible mobile tripod (3940). The drive system (3910) preferably includes a drive motor (3950), a gear box (3960), a drive housing (3970), an up-relay (3980) and a down-relay (3990). The up and down relays are preferably double pole/double throw relays. However, the drive system (3910) could be replaced with any suitable manual lift system (not shown). The manual lift system may be locked to any appropriate height. The telescoping tube (3920) includes an outer support tube (4000), an inner cover tube (4010), a rack gear (4020) and a stop collar (4030). However, other types of extendable supports besides telescoping tube (3920) may also be used. The drive motor (3950) drives an input of the gear box (3960) and an output shaft (4040) is driven by an output of the gear box (3960). A pinion gear (4050) is retained on the output shaft (4040) and the rack gear (4020) is driven by through the pinion gear (4050). The gear box (3960) reduces the speed of the drive motor (3950). Small electric motor gear boxes are well known in the art and need not be explained in detail. The drive motor (3950) is preferably a DC motor, but other motors could also be used.

The drive housing (3970) includes a first housing half (4060) and a second housing half (4070). Each end of the output shaft (4040) is rotatably supported by the first and second housing halves. The first housing half (4060) includes a first tube slot (4080) and the second housing half (4070) includes a second tube slot (4090). The first and second tube slots are sized to receive an outer perimeter of the outer support tube (4000). The first and second housing halves are secured to the inner cover tube (4010) with a plurality of fasteners (4100). A drive system cover (4110) is attached to an outside perimeter of the first housing half (4060) with a plurality of fasteners (4120). The up and down relays are retained in the drive system cover (4110). An inlet hole (4130) is formed through a wall of the drive system cover (4110) to receive an inlet electrical connector (4140). The inlet electrical connector (4140) is attached to the drive system cover (4110) with at least two fasteners (4150). The inlet electrical connector (4140) is connected to the electronic controller or programmable logic circuit (315) with an electrical cable (not shown).

The inlet electrical connector (4140) includes a ground line (4142), a power supply line (4144) and a retract power line 4146. A switch opening (4170) is formed through a wall of the drive system cover (4110) to receive an up-down switch (4160). The up-down switch (4160) is an on-off-on switch. The up-down switch (4160) includes an off-pole (4162), a first on-pole (4164) and a second on-pole (4166). The off-pole (4162) of the up-down switch (4160) is connected to the power supply line (4144) of the inlet electrical connector (4140). A switch lever (4168) of the up-down switch (4160) is toggled to the first on-pole (4164) to raise the inner cover tube (4010). The electrical power flowing through the first on-pole (4164) energizes the up-relay (3980), which sends electrical power to the drive motor (3950) through a first contact (3982) and provides a path to ground for the drive motor (3950) through a second contact (3984). The electrical power flowing through the first on-pole (4164) is connected in series with a reset fuse (4172), which prevents the motor (3950) from being damaged, when the vent cover door (3930) is forced against the vent opening (4355). The motor (3950) is preferably a permanent magnet DC motor. Electromagnetic braking is inherent in permanent magnet DC motors. The electromagnetic braking keeps the vent cover door (3930) in contact with the vent opening (4355). The switch lever (4168) is toggled to the second on-pole (4166) to lower inner cover tube (4010). The electrical power flowing through the second on-pole (4166) energizes the down-relay (3990), which sends electrical power to the drive motor (3950) through a first contact (3992) and provides a path to ground for the drive motor (3950) through a second contact (3994). The retract power line (4146) is connected to the second on-pole (4166). Electrical power supplied through the retract power line (4146) will also lower the inner cover tube (4010).

The vent cover door (3930) includes a cover plate (4180), a peripheral sealing ring (4190) and a tube flange (4200). The peripheral sealing ring (4190) is attached to a top of the cover plate (4180) and around a perimeter thereof. The peripheral sealing ring (4190) is preferably fabricated of rubber, a rubber like material or any other suitable material. The tube flange (4200) is attached to a bottom of the cover plate (4180). The tube flange (4200) includes a tube opening (4210), which is sized to receive the inner cover tube (4010.) A tightening screw (4212) is used to secure the inner cover tube (4010) in the tube flange (4200). The rack gear (4020) is attached to the inner cover tube (4010) with a plurality of fasteners (4220). An end cap (4012) is preferably retained in a bottom of the inner cover tube (4010) with at least one fastener (4014). A rack slot (4230) is formed in the outer support tube (4000) to provide clearance for the rack gear (4020). The stop collar (4030) includes a clamp slot (4032), a tube opening (4034) and a stud slot (4036). A threaded stud (4240) is secured in the stud slot (4036) with a pair of nuts (not shown) secured to a top and bottom of the stop collar (4030). The threaded stud (4240) is positioned to actuate a normally closed limit switch (4250) to an open position to stop the flow of electricity to the down-relay (3990). The threaded stud (4240) is axially and radially adjusted to actuate a lever (4252) of the limit switch (4250) and stop the flow of electricity to the drive motor (3950), just before the down stop strikes a top of the drive housing (3970). A clamping fastener (4260) is tightened to secure the stop collar (4030) on the inner cover tube (4010).

Figure 1:
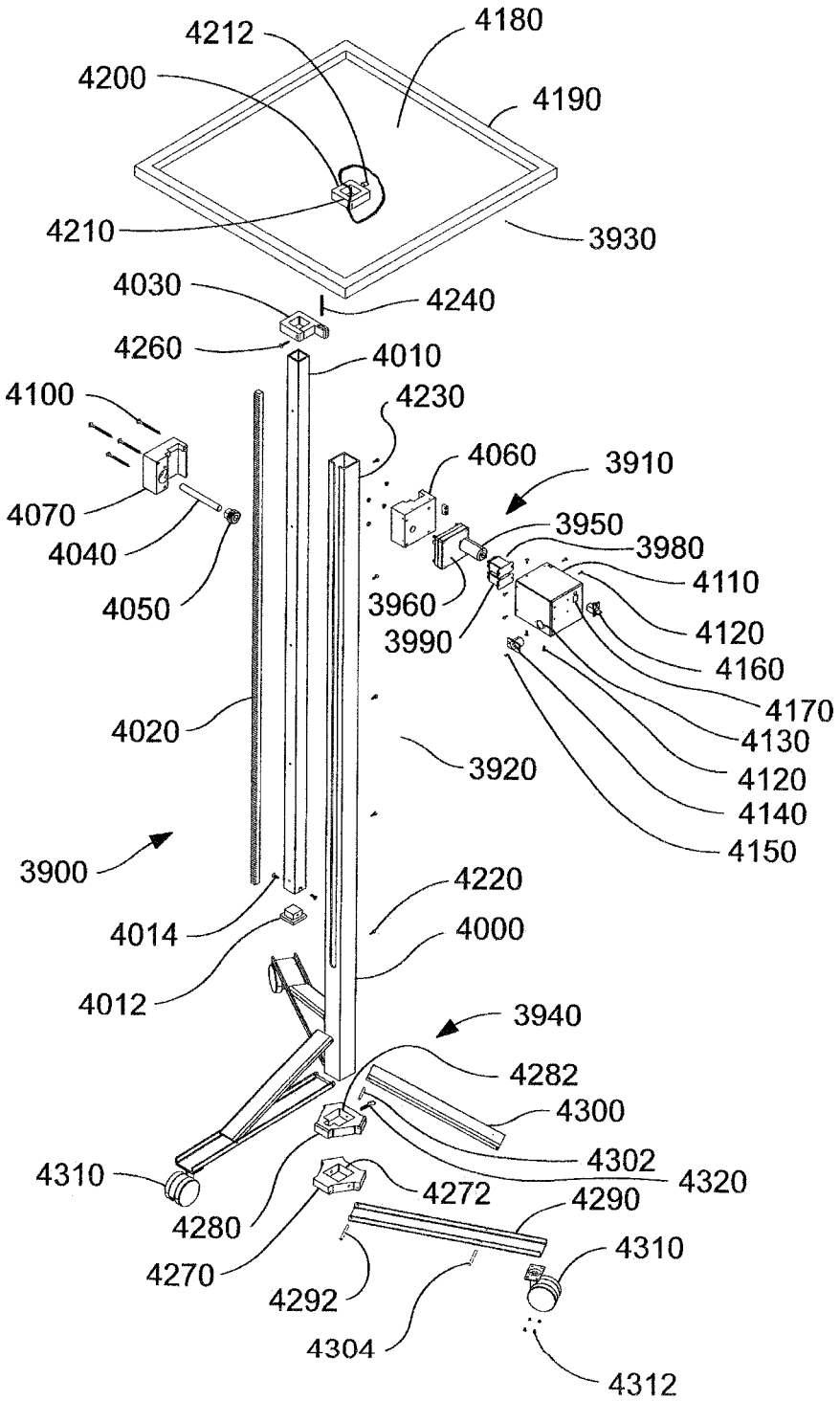
FIG. 1 is an exploded perspective view of a portable automated vent cover.
Figure 2:
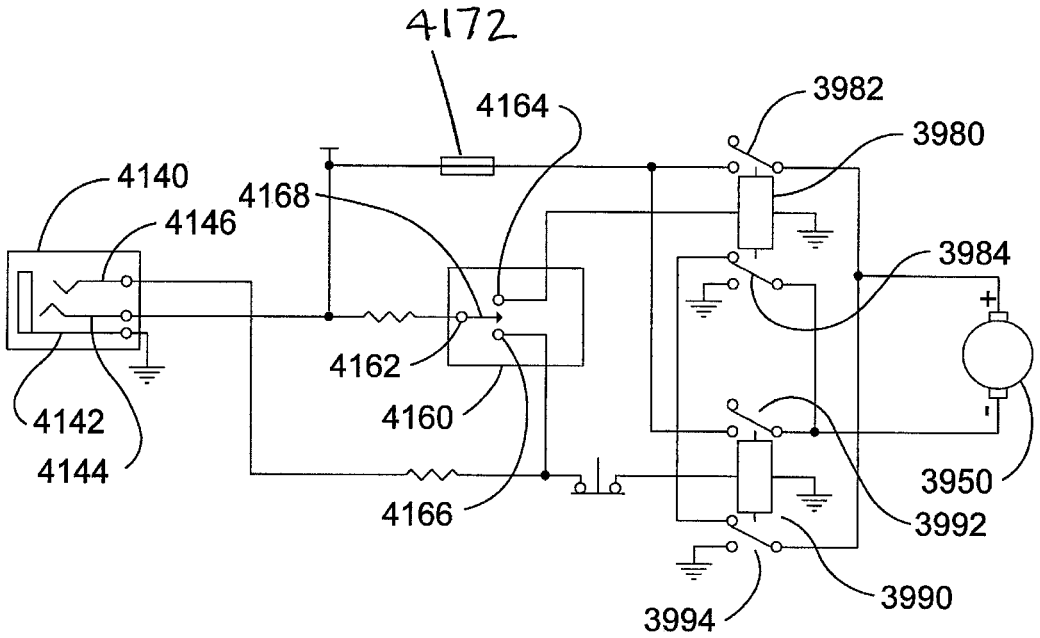
FIG. 2 is an electrical schematic of a portable automated vent cover.
Figure 3:
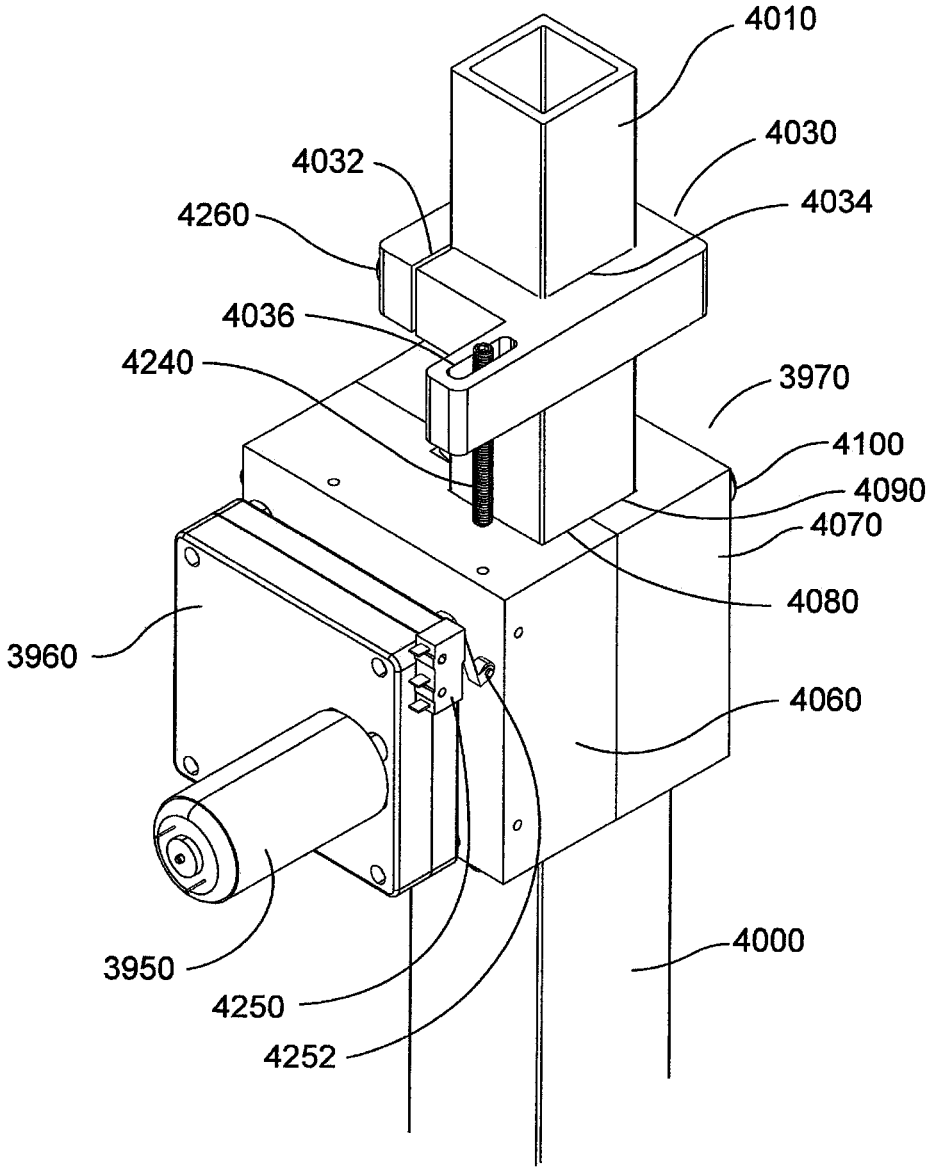
FIG. 3 is an enlarged perspective view of a drive system of a portable automated vent cover with a down stop in a raised position.
Figure 4:
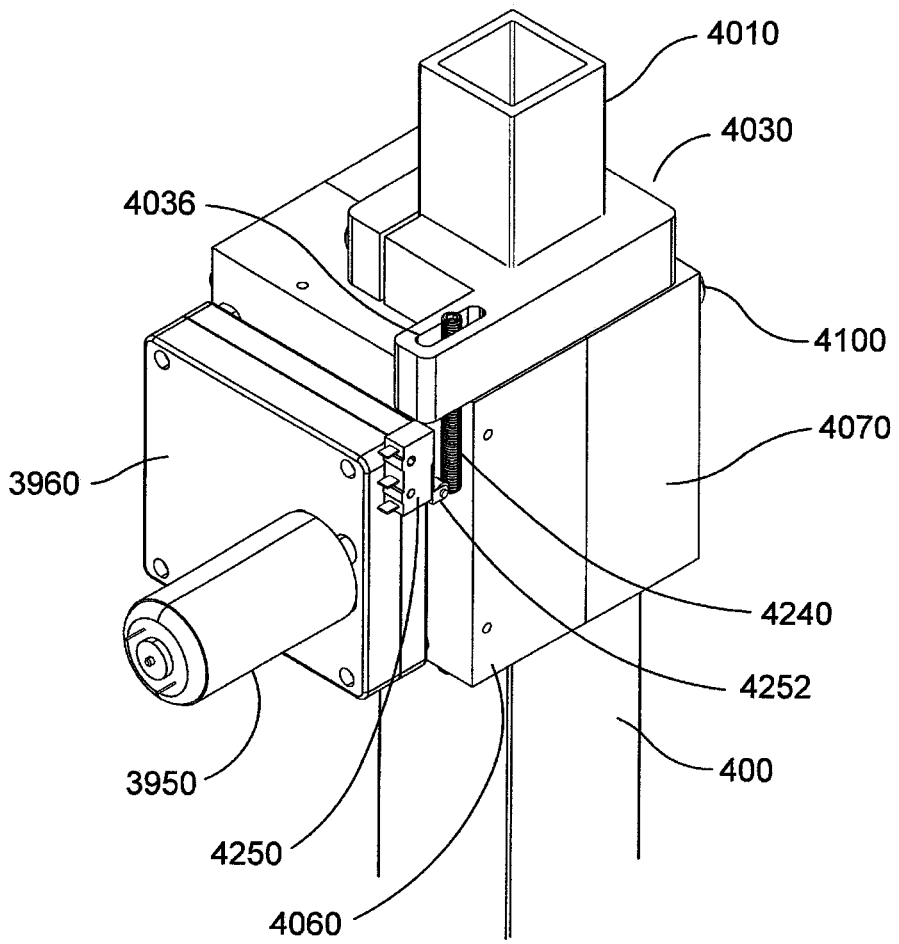
FIG. 4 is an enlarged perspective view of a drive system of a portable automated vent cover with a down stop in a lowered position.
Figure 5:
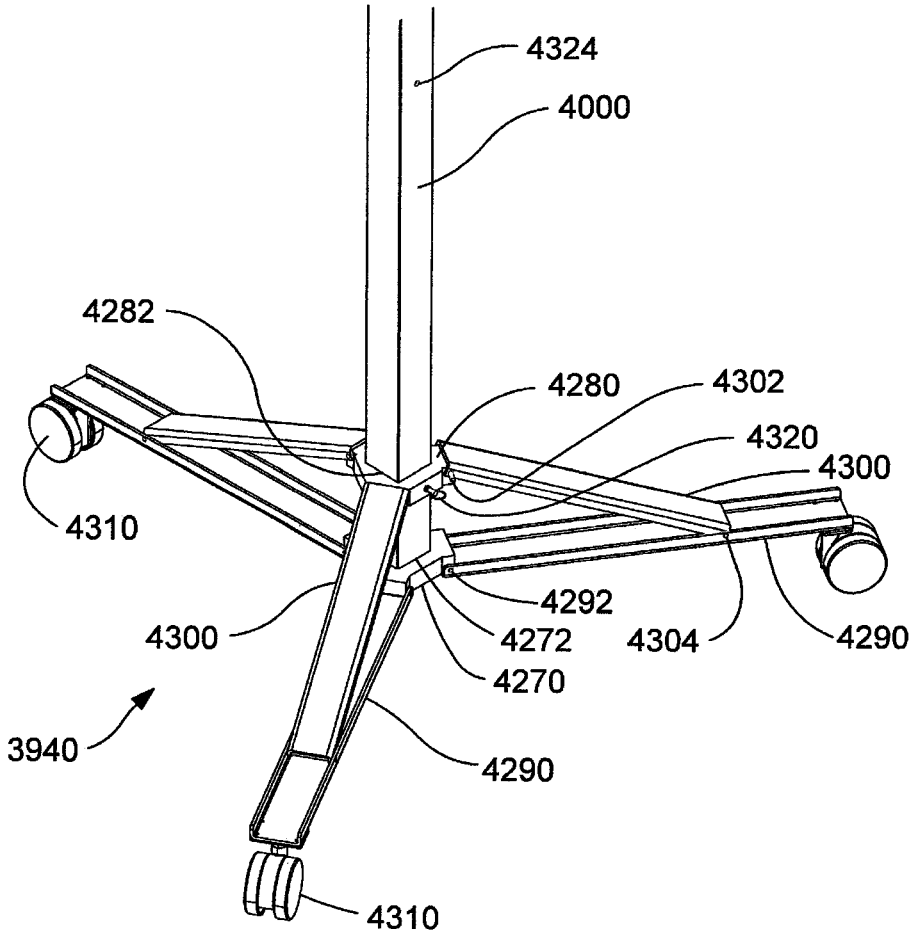
FIG. 5 is an enlarged perspective view of a mobile tripod of a portable automated vent cover.

With reference to FIGS. 5-6, the collapsible mobile tripod (3940) preferably includes a stationary pivot block (4270), a sliding pivot block (4280), three lower support arms (4290), three upper support arms (4300) and three castors (4310). The stationary pivot block (4270) includes a tube opening (4272), which is sized to receive the outer support tube (4000). The stationary pivot block (4270) is attached to a bottom of the outer support tube (4000) with any suitable device or method, such as fasteners. One end of the three lower support arms (4290) are pivotally attached equidistant around a perimeter of the stationary pivot block (4270) with three pivot pins (4292). The three castors (4310) are attached to a bottom of the other end of the three lower support arms (4290) with a plurality of fasteners (4312). The sliding pivot block (4280) includes a tube opening (4282), which is sized to slidably receive the outer support tube (4000).

One end of the three upper support arms (4300) are pivotally attached equidistant around a perimeter of the sliding block (4280) with three pivot pins (4302). The other end of the three upper support arms (4300) are pivotally attached to the three lower support arms with three pivot pins (4304). A locking pin (4320) is inserted through the sliding support block (4280) and a support hole (4322) or a retraction hole (4324) in the outer support tube (4000) to place the mobile tripod in a support orientation or a retracted orientation, respectively.

Figure 8:
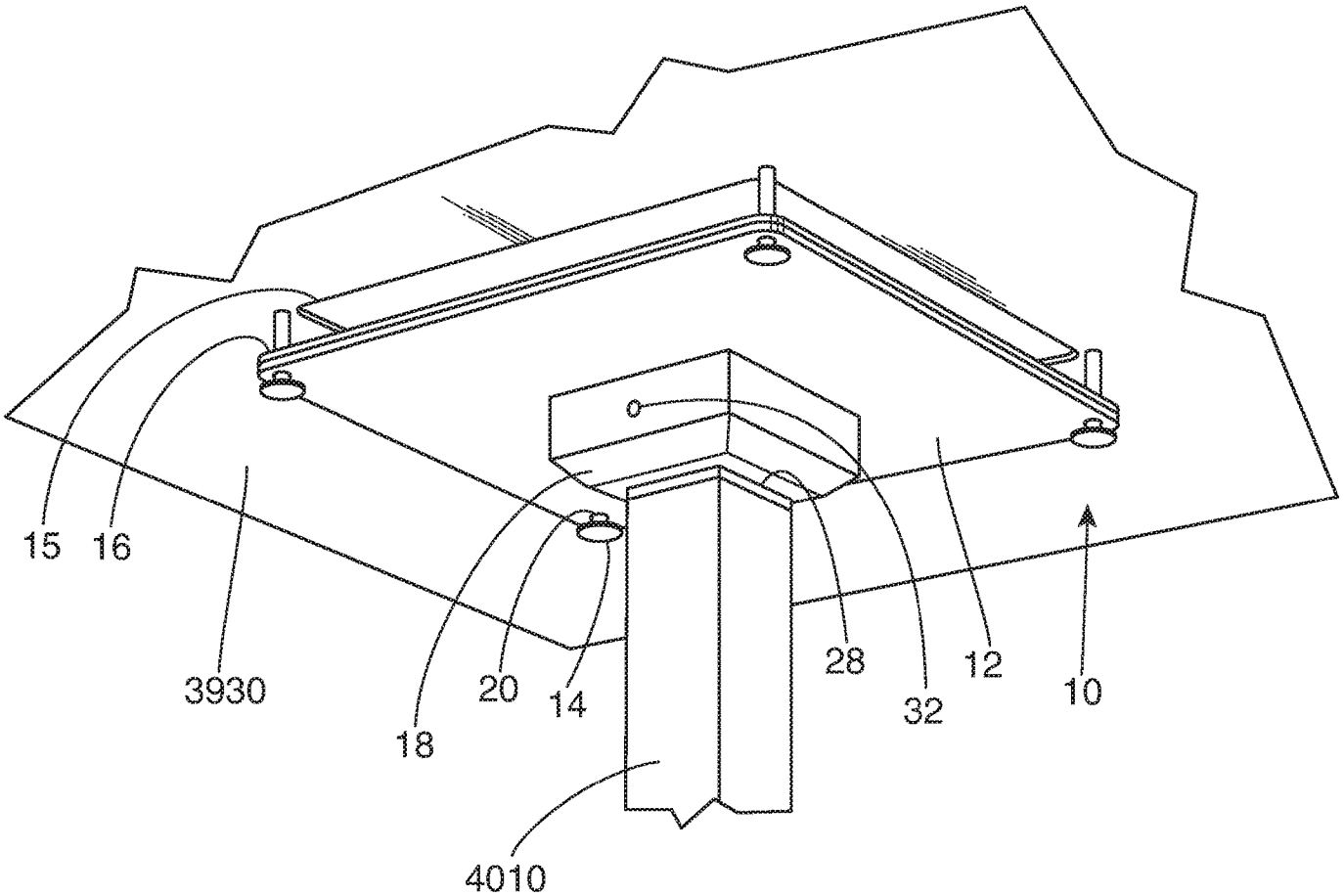
FIG. 8 is a bottom perspective view of a vacuum release door fully withdrawn from a vent cover door of a vent cover system in accordance with the present invention.
Figure 9:
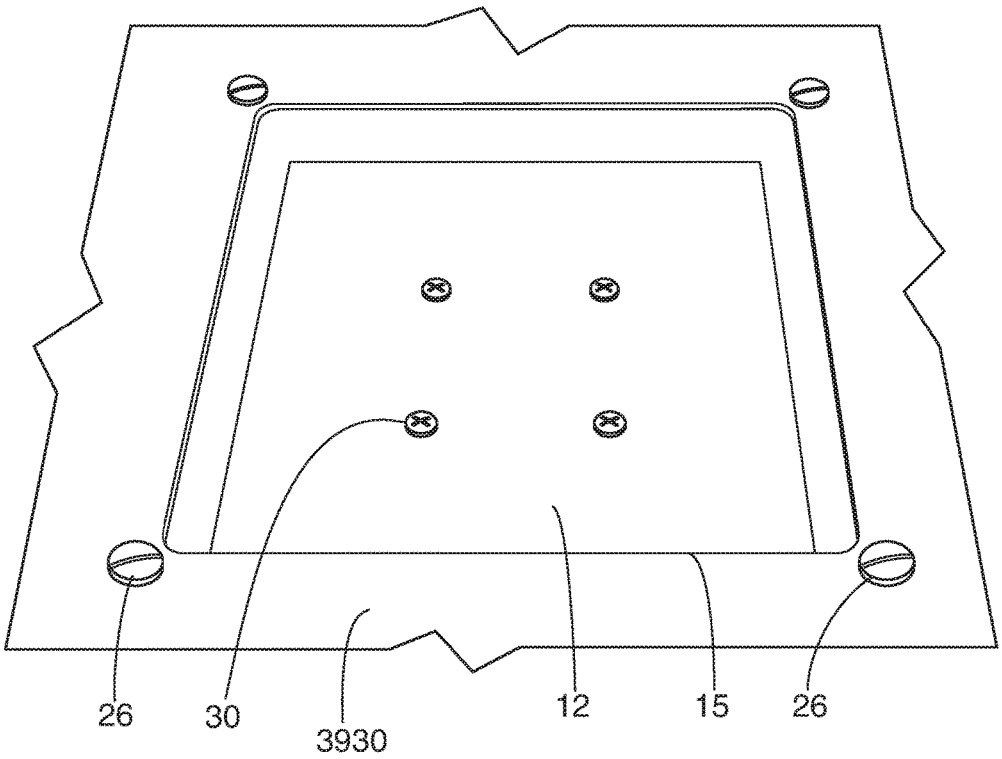
FIG. 9 is a top perspective view of a vacuum release door in contact with a vent cover door of a vent cover system in accordance with the present invention.

With reference to FIGS. 7-9, the vacuum release door (10) preferably includes a vacuum door plate (12), a plurality of retention pins (14), a sealing gasket (16) and a tube flange (18). The sealing gasket (16) preferably includes the same outer perimeter as the vacuum door plate (12). The sealing gasket (16) is preferably fabricated from rubber, a rubber like material, or any suitable material. A vacuum break opening (15) is formed through a center of the vent cover door (3930). The vacuum door plate (12) has an outer perimeter that is larger than a perimeter of the vacuum break opening (15). The sealing gasket (16) is attached to a top of the vacuum door plate (12). A plurality of pin holes (20) are formed around a perimeter of the vacuum door plate (12) to slidably receive the plurality of retention pins (14). Each retention pin (14) includes a head portion (22) and a pin portion (24). The pin portion (24) extends from the head portion (22). The pin portion (24) is inserted through the plurality of pin holes (20) and attached to the vent cover door (3930) with fasteners (26) or the like. Alternatively, and without limitation, the pin portion (24) is inserted through the plurality of pin holes (20) and attached to the vent cover door (3930) and/or the cover plate (4180), with fasteners (26) or the like. The pins (24) may also be suitably terminated on both ends, so they can perform their intended purposes, while also being able to have axial movement in the pin holes (20). However, other devices may also be substituted for the plurality of retention pins (14), such as but not limited to any type of guide rails. The tube flange (18) includes a tube opening (28), which is sized to snugly receive a top end of the inner cover tube (4010). The tube flange (18) is attached to a bottom of the vacuum door plate with fasteners (30) or the like. The inner cover tube (4010) is retained in the tube flange (18) with a pin (32) or the like.

In use, the vent cover door (3930) is raised, until a peripheral sealing ring (4190) on a top of the vent cover door (3930) seals around and/or to a perimeter of a vent opening (not shown). When an attempt is made to lower the vent cover door (3930) from the vent opening, retraction of the inner cover tube (4010) will cause a seal to be broken between the vacuum door plate (12) and the vacuum break opening (15) in the vent cover door (3930). After the seal is broken, the plurality of retention pins (14) will experience a downward force, which will cause a seal between the vent cover door 3930 and the vent opening to be broken. The vent cover system (1) makes it easier to break a seal between the vent opening and the vent cover door (3930), because the perimeter of the vacuum release door (12) is much shorter than a perimeter of the vent cover door (3930).

An air gap between a bottom of the vent cover door (3930) and a top of the vacuum door plate 12 is preferably, and without limitation, at least ⅛ inch, when the vacuum door plate (12) is in an open position. The vacuum door plate (12) seals the vacuum break opening (15) in a closed orientation. The vacuum door plate (12) does not cover the vacuum break opening (15) in an open orientation. It is easier to break a small perimeter seal than a large perimeter seal.

Figure 10:
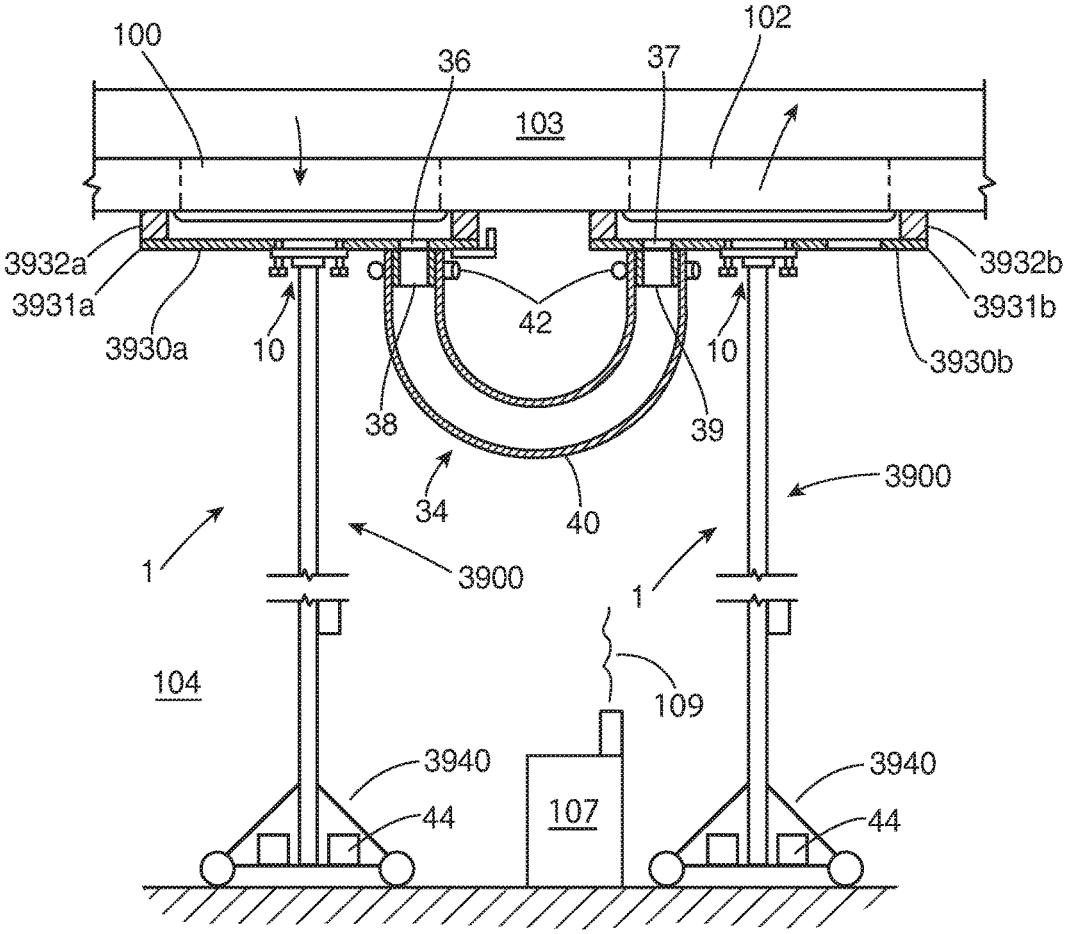
FIG. 10 is a side partially cross sectional view of a first vent cover system adjacent to a second vent cover system connected to each other with a vent bypass system in accordance with the present invention.
Figure 11:
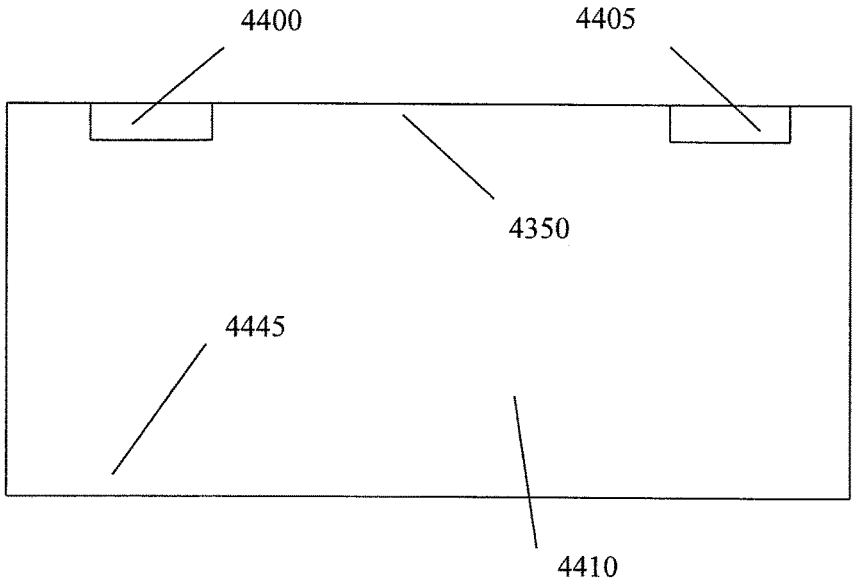
FIG. 11 is a side view of a treated room or space with at least one gas entry vent and at least one gas exit vent of a vent bypass system in accordance with the present invention.

With reference to FIG. 10, a vent bypass system (34) is created by forming a bypass hole (36) through a vent cover door (3930*a*), (3930*b*) of two adjacent vent cover systems (1). The two adjacent vent cover systems (1) are contained in an enclosed space (104). Disinfection equipment (107) contained in the enclosed space 104 decontaminates the enclosed space 104 with an aerosol (109). A tube flange (38) extends from a bottom surface of the vent cover door (3930*a*), (3930*b*), concentric with the bypass hole (36). The first vent cover door (3930*a*) covers an entry vent (100) and the second vent cover door (3930*b*) covers an exit vent (102). The entry vent (100) and the exit vent (102) are part of a HVAC system (103). A first end of a flexible tube (tubular member) (40) is secured to the tube flange (38) of the first vent cover door (3930*a*) with a securement device, such as a hose clamp (42) or the like, and a second end of the flexible tube (40) is secured to the second tube flange (38) of the second vent cover door (3930*b*). The flexible tube or tubular member may have any suitable cross-sectional shape.

Gas blown into the enclosed space (104) will bypass circulating through the enclosed space (104) by going through the flexible tube 40 from the entry vent (100) to the exit vent (102). The vent bypass system (34) will also keep a balance in a circulating system by not sealing up a normal flow pattern through the room. Additionally, more than one entry vent (100) may be transferred to one exit vent 102 with more than one tube (40), or one entry vent (100) may be transferred to more than one exit vent (102) with more than one tube (40).

With reference to FIGS. 11-15, an alternative embodiment of the vent bypass system (4415) can be positioned to and/or sealed against gas vents (4400) and (4405) in various ways including, but not limited to, automatically using any automated vent cover apparatus (3900), and/or manually using any manually adjustable vent cover holding and sealing apparatus (4430).

Without being limited, the vent bypass system (4415), can also include various components, such as, but not limited to any, vacuum release door(s) (10), vacuum break opening(s) (15), vent cover door(s) (3930), hose(s) (4380), and hose connection(s) (4420).

The hose(s) (4380) can effectively connect and operate with any apparatus or component that can effectively seal any air/gas entry vent (s) (4400) and any air/gas exit vent (s) (4405). It is preferred, without limitation that the hose(s) (4380) connect to the various vent cover door(s) (3930) with one or more of any hose connection(s) (4420). Without being limited, the hose(s) (4380) can allow any air/gas to flow out from one or more vent(s) (4400) that opens into a room (a) or connected space(s), through the hose(s) (4380), and into and out of another one or more vent(s) (4405) that is in the same room or connected space, allowing the air/gas(s) to leave that room(s) or connected space(s). It is preferred, without limitation, that these one or more room(s) or connected space(s) (4410) are effectively connected and sealed.

More specifically, and without being limited, the hose connection(s) (4420) can include, one or more of any inbound air/gas hose connection(s) (4385) and outbound air/gas hose connection(s) (4390), all known to those skilled in the art, and they can be directly and/or indirectly connected, in various ways including, permanently, semi-permanently, and/or removable, to any vent covering component(s) such as, but not limited to any, vent cover door(s) (3930), or any other connected location(s) and/or component(s), all in a manner known in the art.

Referring again to FIGS. 14-15, and without being limited, any vent(s) connecting to any rooms and/or connected space(s), or any part of any vent(s) such as, but not limited to any, air/gas entry vent(s) (4400), air/gas exit vent(s) (4405), and/or any vent opening(s) (4355), can also be designed to be effectively sealed against the escape of any air/gas(s), while still being effectively sealed to and effectively interfaced with, any hose connection(s) (4420) for the passage of any air/gas(s) to any hose(s) (4380).

Again, with reference to FIGS. 11-15, the hose connection(s) (4420) can allow any gas to pass through one or more of any connected parts, such as, but not limited to any, inbound gas vent(s) (4385), outbound air/gas vent(s) (4390), vent(s) opening(s) (4355), vent cover door(s) (3930), hose(s) (4380), and hose connection(s) (4420), and function effectively as a system for the effective movement, passage, and/or transfer, of any air or gas(s) to, from, and/or through, any vent(s) (4385) (4390) and hose(s) (4380), in any room(s) and/or connected space(s) (4410).

Figure 12:
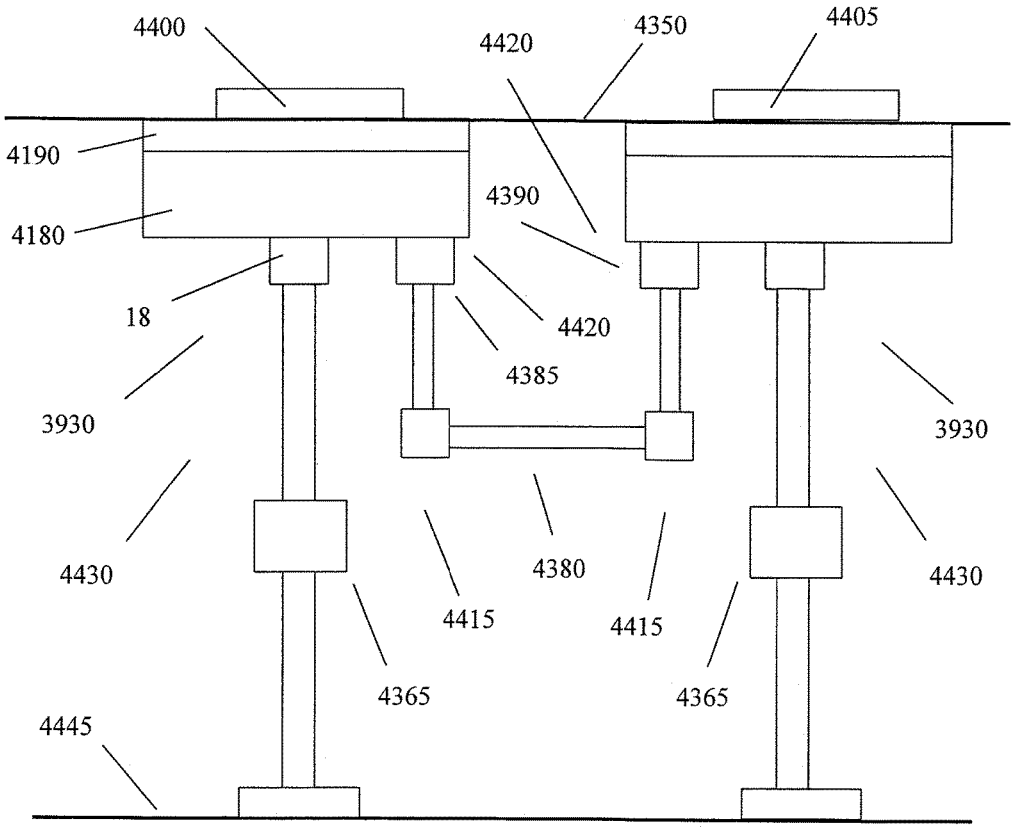
FIG. 12 is a side view of targeted space having an gas entry vent and a gas exit vent, both sealed with a separate vent cover door and a vacuum release door, all in a sealed state, and positioned against a ceiling surface with a manual vent holding apparatus, where both vents are connected via a hose connecting both vent cover doors and their respective vents of a vent bypass system in accordance with the present invention.
Figure 13:
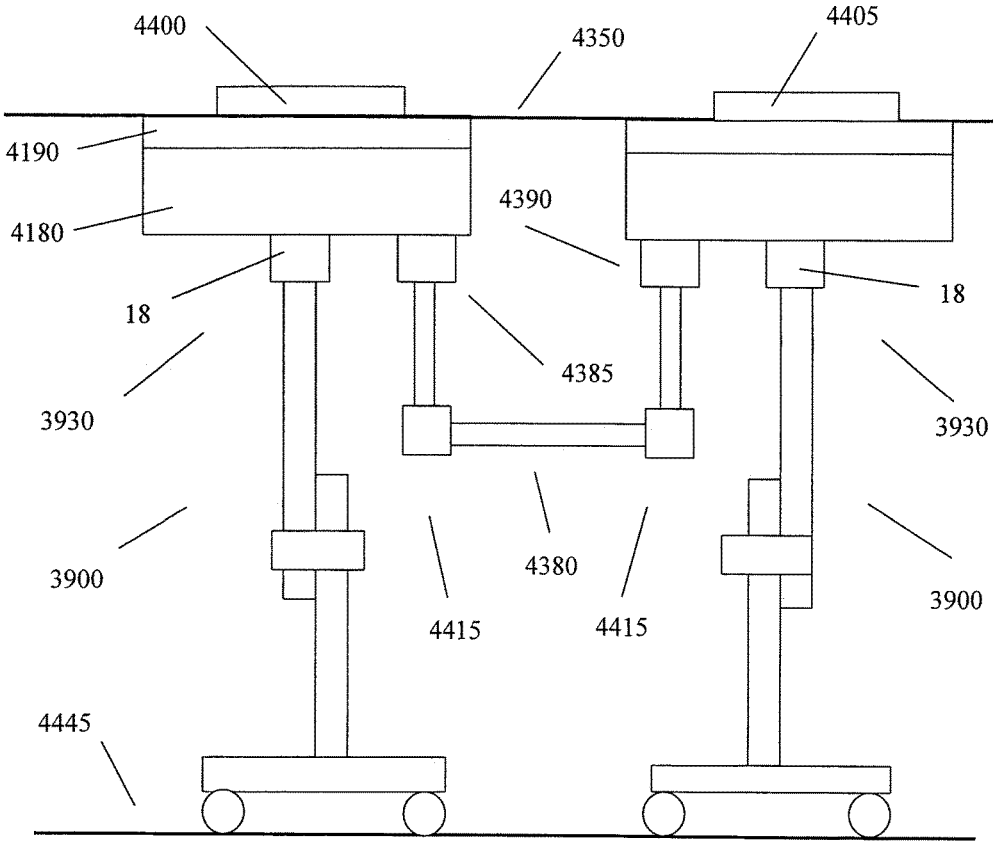
FIG. 13 is a side view of targeted space having an air/gas entry vent and an gas exit vent, both sealed with a separate vent cover door and a vacuum release door, all in a sealed state, and positioned against a ceiling surface with a portable automated vent cover apparatus, where both vents are connected via a hose connecting both vent cover doors and their respective vents of a vent bypass system in accordance with the present invention.
Figure 14:
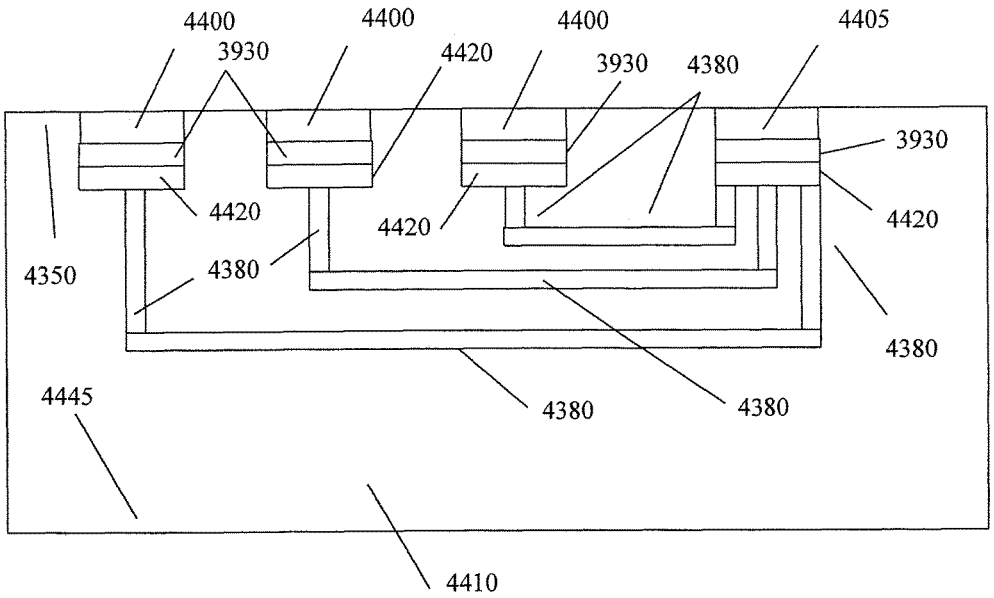
FIG. 14 a side view showing air/gas flowing into a room or connected space from two separate entry vents, and then exiting the room from one exit vent of a vent bypass system in accordance with the present invention.
Figure 15:
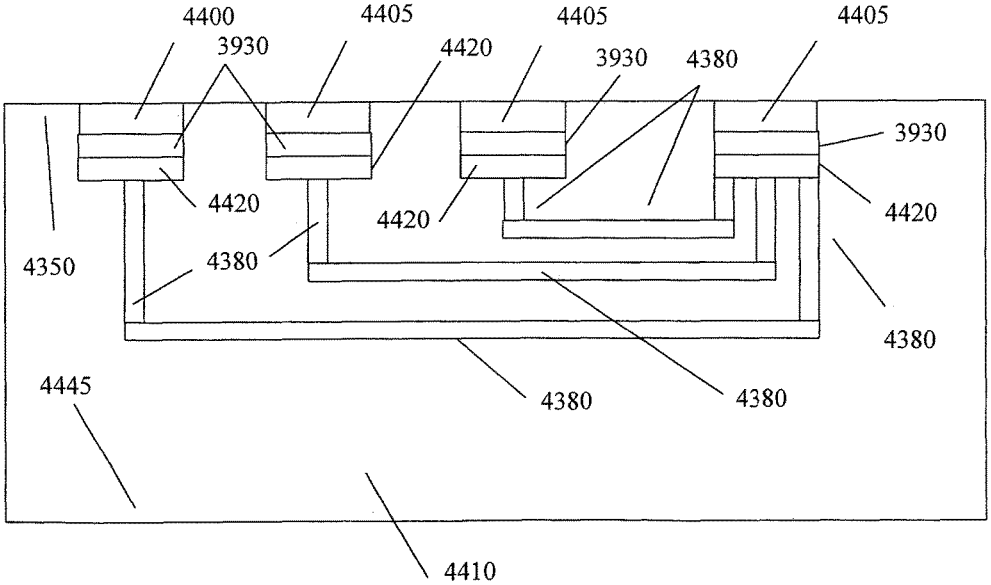
FIG. 15 a side view showing air/gas flowing into a room or connected space from one entry vent, and then exiting the room from three separate exit vents of a vent bypass system in accordance with the present invention.

According to FIGS. 12-13, it is preferred that two separate vent cover and hose bypass systems (4415) are each interfaced with a manually adjustable vent cover holding and sealing apparatus (4430) as shown in FIG. 12, and an automated vent cover apparatus (3900) as shown in FIG. 13, where both apparatus do not include any vacuum release door (10) and vacuum break opening (15).

Referring to FIGS. 12-13 and without limitation, the vent cover door (3930) belonging to a first vent cover and hose bypass system (4415), effectively seals an air/gas entry vent (4400), while another separate vent cover door (3930) belonging to another second vent cover and hose bypass system (4415), effectively seals an air/gas exit vent (4405).

At least one hose (4380) connects the first vent cover and hose bypass system (4415) to the second vent cover and hose bypass system (4415). The hose(s) (4380) effectively connect to each vent cover door (3930) via at least one hose connection(s) (4420). More specifically, the inbound air/gas hose connection (4385) effectively connects the hose (4380) to the vent cover door (3930) that effectively covers and/or seals the air/gas entry vent (4400), while the same hose (4380) effectively connects with the outbound air/gas hose connection (4390) that connects with the vent cover door (3930) that effectively covers and/or seals the air/gas exit vent (4405). The flow of air/gas bypasses flowing into the enclosed space and flows back into the ventilation system.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method of preventing gas flow into and out of an enclosed space through at least three vents of a HVAC system, such that the enclosed space may be decontaminated with disinfection equipment inside the enclosed space, comprising the steps of:

sealing at least two entry vents of a HVAC system such that no gas from the at least entry vents enter the enclosed space;

sealing at least one exit vent of said HVAC system such that no gas in the enclosed space exits through the at least one exit vent;

connecting one end of at least two tubular members to the at least two entry vents, such that gas flows into said one end of said at least two tubular members; and connecting an opposing end of said at least two tubular members to said at least one exit vent, such that the gas flows directly from said at least two entry vents into said at least one exit vent through said at least two tubular members.

2. The method of preventing gas flow into and out of an enclosed space through at least three vents of a HVAC system of claim 1, further comprising the step of:

providing at least two first vent covers having a first sealing ring formed at least around a perimeter for sealing to the at least two entry vents, at least one first bypass hole formed through said at least first vent covers; and providing at least one second vent cover having a second peripheral sealing ring formed at least around a perimeter for sealing to the at least one exit vent, at least one second bypass hole formed through said at least one second vent cover.

3. The method of preventing gas flow into and out of an enclosed space through at least three vents of a HVAC system of claim 2, further comprising the step of:

connecting a tube flange of one of said at least two first vent covers covering one of the at least two entry vents to said one end of one of said at least two tubular members; and connecting a tube flange of one of said at least one second vent cover covering one of the at least one exit vent to said opposing end of said one of said at least two tubular members.

4. The method of preventing gas flow into and out of an enclosed space through at least three vents of a HVAC system of claim 1, further comprising the step of:

making said at least two tubular members flexible.

5. A method of preventing gas flow into and out of an enclosed space through at least three vents of a HVAC system, such that the enclosed space may be decontaminated with disinfection equipment inside the enclosed space, comprising the steps of:

sealing at least two entry vents of a HVAC system such that no gas from the at least two entry vents enter the enclosed space;

sealing at least one exit vent of said HVAC system such that no gas in the enclosed space exits through the at least one exit vent;

connecting one end of at least two tubular members to the at least two entry vents, such that gas flows into said one end of said at least two tubular member; and connecting an opposing end of said at least one tubular member to said at least one exit vent, such that the gas flows directly from said at least two entry vents into said at least one exit vent through said at least two tubular members, connecting an opposing end of said at least two tubular members to said at least one exit vent, such that the gas flows directly from said at least two entry vents into said at least one exit vent through said at least two tubular members, a flow of gas bypassing circulating through the enclosed space and passing through said at least one tubular member back into the HVAC system.

6. The method of preventing gas flow into and out of an enclosed space through at least three vents of a HVAC system of claim 5, further comprising the step of:

providing at least two first vent covers having a first sealing ring formed at least around a perimeter for sealing to the at least two entry vents, at least one first bypass hole formed through said at least first vent covers; and providing at least one second vent cover having a second sealing ring formed at least around a perimeter for sealing to the at least one exit vent, at least one second bypass hole formed through said at least one second vent cover.

7. The method of preventing gas flow into and out of an enclosed space through at least three vents of a HVAC system of claim 6, further comprising the step of:

connecting a tube flange of one of said at least two first vent covers covering one of the at least two entry vents to said one end of one of said at least two tubular members; and connecting a tube flange of one of said at least one second vent cover covering one of the at least one exit vent to said opposing end of said one of said at least two tubular members.

8. The method of preventing gas flow into and out of an enclosed space through at least three vents of a HVAC system of claim 5, further comprising the step of:

making said at least two tubular members flexible.

9. The method of preventing gas flow into and out of an enclosed space through at least two vents of a HVAC system of claim 8, further comprising the step of:

making said at least two tubular members flexible.

10. A method of preventing gas flow into and out of an enclosed space through at least three vents of a HVAC system, such that the enclosed space may be decontaminated with disinfection equipment inside the enclosed space, comprising the steps of:

sealing at least one entry vent of a HVAC system such that no gas from the at least one entry vent enters the enclosed space;

sealing at least two exit vents of said HVAC system such that no gas in the enclosed space exits through the at least two exit vents;

connecting one end of at least one tubular member to the at least one entry vent, such that gas flows into said one end of said at least one tubular member; and connecting an opposing end of said at least one tubular member to one of said at least two exit vents, such that the gas flows directly from said at least one entry vent into said one of said at least two exit vents through said at least one tubular member; and connecting one end of at least one second tubular member to said one of said at least two exit vents, connecting an opposing end of said at least one second tubular member to a second of said at least two exit vents.

11. The method of preventing gas flow into and out of an enclosed space through at least three vents of a HVAC system of claim 10, further comprising the step of:

providing at least one first vent cover having a first sealing ring formed at least around a perimeter for sealing to the at least one entry vent, at least one first bypass hole formed through said at least one first vent cover; and providing at least two second vent covers having a second peripheral sealing ring formed at least around a perimeter for sealing to the at least two exit vents, at least one second bypass hole formed through said at least two second vent covers.

12. The method of preventing gas flow into and out of an enclosed space through at least three vents of a HVAC system of claim 10, further comprising the step of:

connecting a tube flange of one of said at least one first vent cover covering one of the at least one entry vent to said one end of said at least one tubular member; and connecting a tube flange of one of said at least two second vent covers covering one of the at least two exit vents to said opposing end of said at least one tubular member.

* * * * *